US006932646B2

(12) United States Patent
Sloey

(10) Patent No.: US 6,932,646 B2
(45) Date of Patent: Aug. 23, 2005

(54) ELECTRICAL CONNECTOR ASSEMBLY STRUCTURE

(75) Inventor: Jason S. Sloey, San Diego, CA (US)

(73) Assignee: North Star Systems Corp., Taipei (TW)

( * ) Notice: Subject to any disclaimer, the term of this patent is extended or adjusted under 35 U.S.C. 154(b) by 24 days.

(21) Appl. No.: 10/406,191

(22) Filed: Apr. 4, 2003

(65) Prior Publication Data

US 2004/0198073 A1 Oct. 7, 2004

(51) Int. Cl.[7] ..... H01R 13/648
(52) U.S. Cl. ..... 439/607; 439/660
(58) Field of Search ..... 439/607, 660, 439/608, 609, 610

(56) References Cited

U.S. PATENT DOCUMENTS 5,782,646 A * 7/1998 Broadfield et al. ..... 439/346
5,812,660 A * 9/1998 Suzuki et al. ..... 379/438
6,093,057 A * 7/2000 Lok ..... 439/607
6,322,396 B1 * 11/2001 Kuan ..... 439/607
6,716,064 B2 * 4/2004 Kubo ..... 439/607

* cited by examiner

*Primary Examiner*—Thanh-Tam Le
(74) *Attorney, Agent, or Firm*—Troxell Law Office, PLLC

(57) ABSTRACT

A modified structure for an electrical connector assembly provides connection between electronics, such as mobiles, notebooks, digital cameras, personal digital assistants (PDAs), wherein the electrical connector assembly includes a female connector assembly for insertion and connection, and a mating connector. By interlocking said female connector and mating connector and further in connection with the independent power supply, data and power supply are integrated in the structure design of the electrical connector. This prevents data loss, computer breakdown or interruption of power supply while transmitting data caused by loosening of connection between the mating connector and the female connector assembly.

3 Claims, 6 Drawing Sheets

ELECTRICAL CONNECTOR ASSEMBLY STRUCTURE

BACKGROUND OF THE INVENTION

1) Field of the Invention

The present invention relates to a modified structure for an electrical connector assembly, more particularly in connection between electronic products such as mobile phones, notebooks, digital cameras, personal digital assistants (PDAs) in order to integrate data transmission and power supply.

2) Description of the Prior Art

Electrical connectors are widely used in connection with electrical signals, such as the connection between signal source and various electronics or electrical equipments. Through them, signal source is able to provide signals or power to electronics or electrical equipments. Therefore, it is necessary to enhance the connection structure between female connector assembly and mating connector of electrical connectors in order to keep the line open.

The technique in manufacturing the conventional electrical connector depends on the material and structure of connection terminals, and the delicate fitness between the female connector assembly and mating connector. However, it is known to the connector manufacturers that the material of connectors is extruded plastic, whereas volume change with temperature of the material and the controllable scope of the error in extrusion are concerned, the flaw rate in production and the exceeding cost is undoubtly high.

Moreover, when connection terminals are used as the connecting components for connectors, the force they bear is very likely to cause distortion in them. This would affect the connection effect of the connectors, not to mention the stability required in data transmission.

SUMMARY OF THE INVENTION

The main purpose of the present invention, a modified structure for electrical connector assembly, comprising a female connector assembly of an electrical connector is to provide connection for a mating connector and integrate power supply in the same electrical connector. Moreover, the power supply is independent. Since a round port and terminals are independently disposed for the connection of power supply to thereby differentiate demands. If the female connector assembly requires only power storage, it can be accomplished by connecting to charger or adaptor independently.

Another purpose of the present invention is to provide a mating connector with a pressing area and groove-mount shields, which are mounted on the inner wall of the slot of the female connector assembly thereby allowing contact engagement. Without applying to the resistance of connection terminals, as used in convention electrical connectors, the present invention ensures the connection between the female connector assembly and mating connector of the electrical connector, thereby expending the lifetime of connection terminals and completing data transmission accurately.

To enable a further understanding of the structure and functions of the invention herein, the brief description of the drawings below are followed by detailed description of the most preferred embodiment of the present invention.

DETAILED DESCRIPTION OF THE PREFERRED EMBODIMENTS

Figure 1:
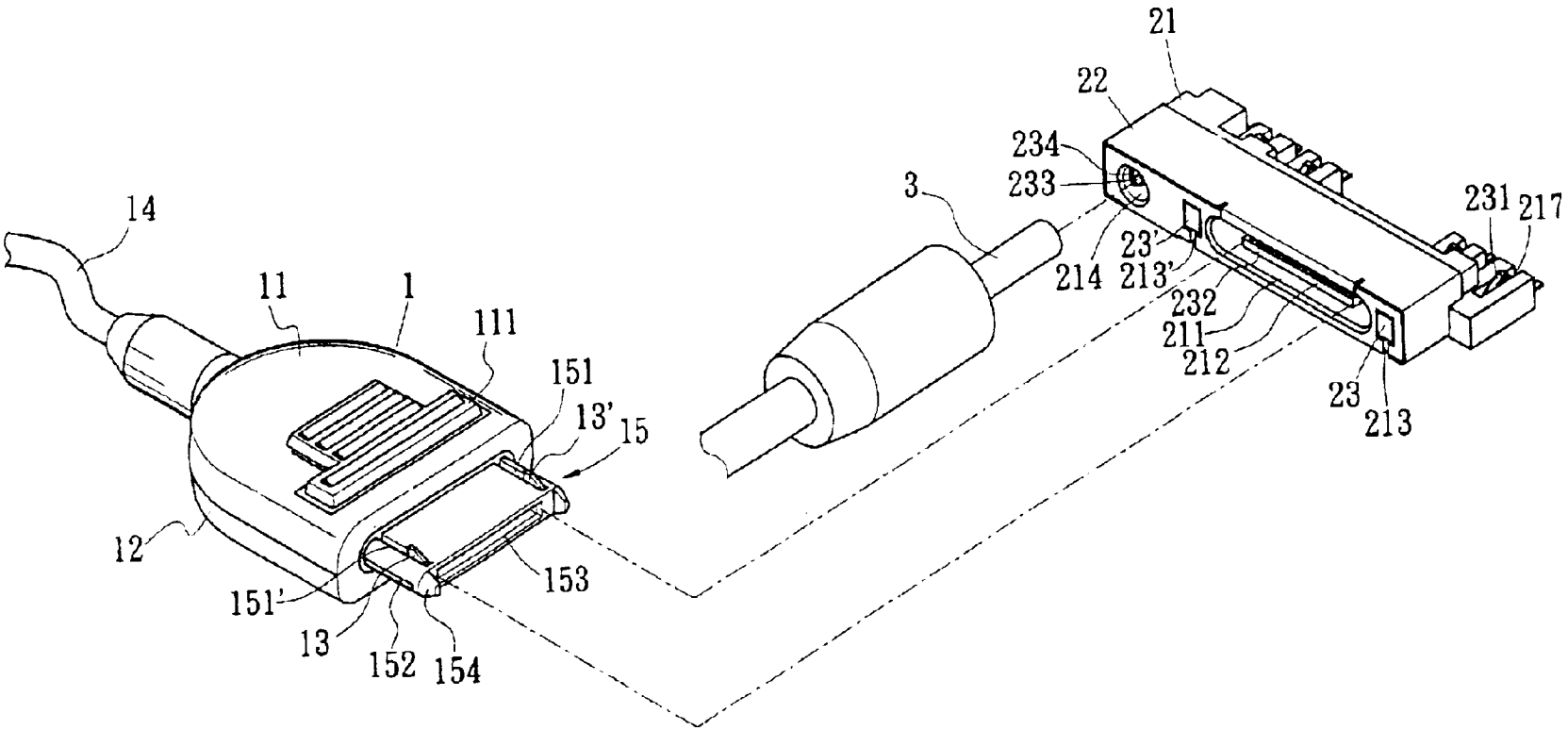
FIG. 1 is a perspective exploded drawing of the present invention, showing a modified structure for an electrical connector assembly.
Figure 2:
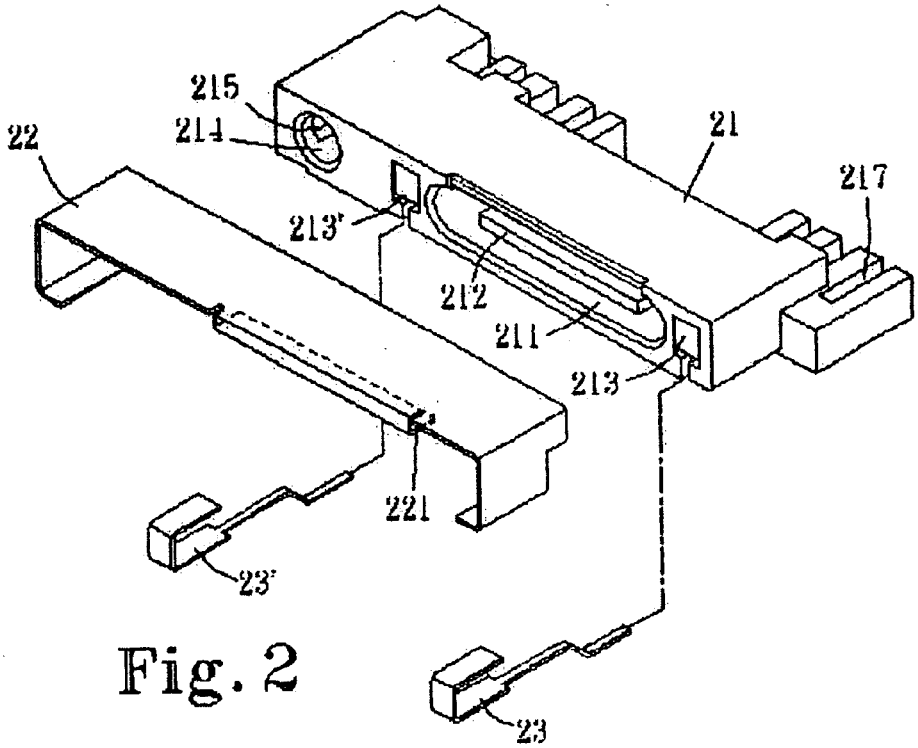
FIG. 2 is a perspective exploded drawing of a female connector assembly of the present invention.
Figure 3:
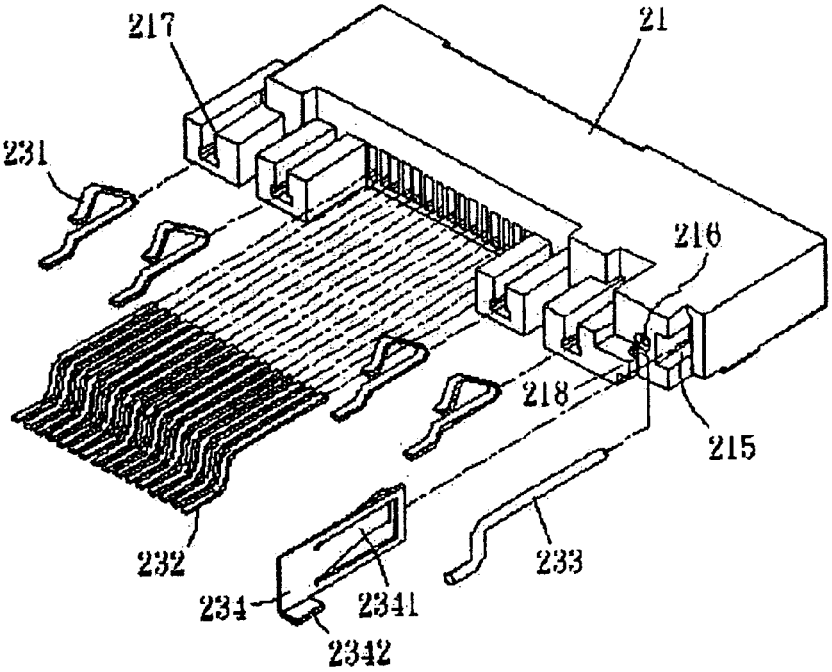
FIG. 3 is another perspective exploded drawing of a female connector assembly of the present invention.

Referring to FIGS. 1, 2 and 3, the present invention comprises a mating connector (1) and a female connector assembly (2). The female connector assembly (2) herein is composed of a container base (21), a metal shield body (22), two correspondent U-shape pins (23, 23'), a plurality of connection terminals (231, 232), a power supply (233) and a stopping terminal (234). A slot (211) opened on one side of the container base (21) which is correspondent with a mating base (15) of the mating connector (1), as shown in FIG. 2. Moreover, a block (212) bulging from the center of the slot (211) comprises a plurality of connection terminals (232). Said block (212) is correspondent to a notch (153) on the mating base (15). When connecting, said block (212) mates with said notch (153) and connects with connection terminals (16) of the mating connector (1). An open slot (213, 213') is disposed on each side of the slot (211) for receiving the U-shape pin (23, 23'). Said U-shape pins (23, 23'), as the positive and negative poles of power supply, thereby providing power storage. The female connector assembly (2) integrates power transmission in an electrical connector by the U-shape pins (23, 23') in order to provide the power required by the server of the female connector assembly (2).

Furthermore, a round port (214) is disposed on one side of the container base (21), which defines a hole (216) and a groove (215). The hole (216) mates with a power supply (233) which is retained by a stopping block (218). A stopping terminal (234) is inserted in the groove (215) and positioned by a blocking piece (2342) thereof. Said stopping terminal (234) also defines a shielding area (2341). The round port (214) receives a plug (3) of power adaptor. One pole of said plug (3) contacts the power supply (233); the other contacts the shielding area (2341) of the stopping terminal (234). Therefore, it provides an alternative power supply, and thus power transmission is integrated in the female connector assembly (2) of the electrical connector. Moreover, the rear side of the container base (21) defines a plurality of identical slot ways (217), and a connection terminal (231) is disposed in each slot way (217) providing connection and retention.

Figure 4:
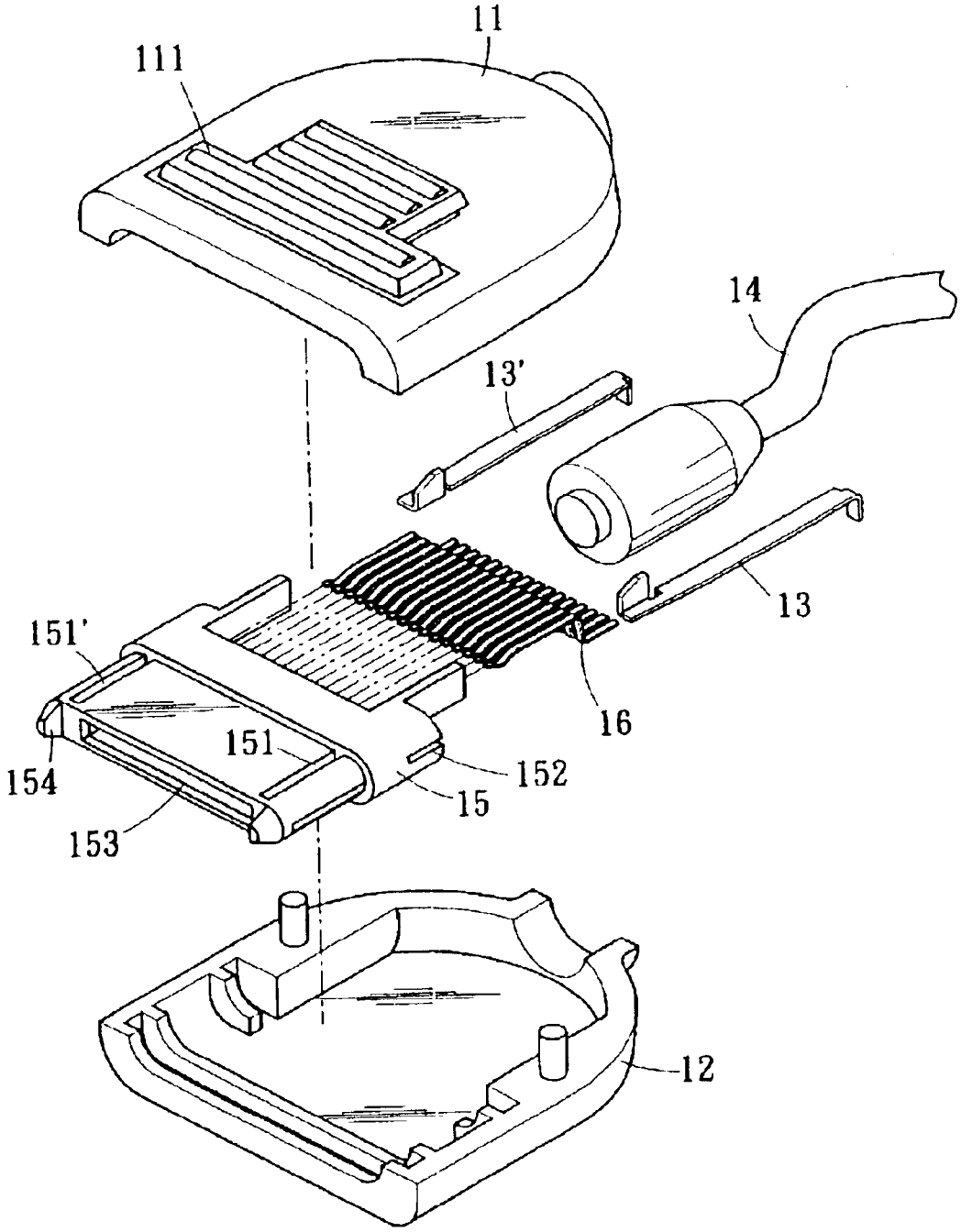
FIG. 4 is a perspective exploded drawing of a mating connector of the present invention.
Figure 6:
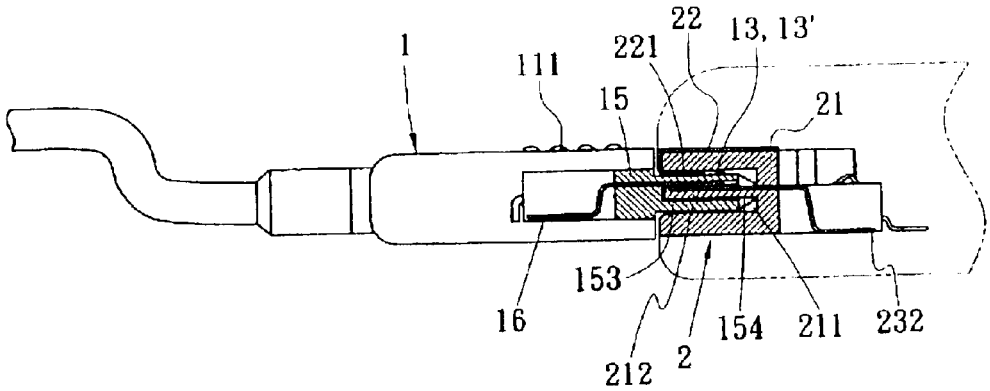
FIG. 6 is a sectional side view of the connection between the female connector assembly and mating connector of the present invention.

As for the structure of the mating connector (1), referring to FIG. 4, having a pair of correspondent covers (11, 12), comprises a mating base (15), a plurality of connection terminals (16), a pair of correspondent groove-mount members (13, 13') and a transmission cable (14) therein. A pressing area (111) is disposed in the middle of the upper cover (11) thereof, which interlockingly controls the groove-mount members (13, 13') inside. Said groove-mount member (13) mounts in a groove (151) via a lateral groove (152), same as the groove-mount member (13') in the groove (151') such that the mating connector (1) and the female connector assembly (2) are able to engage with each other while connecting. This prevents the data loss or transmission breakdown during data transmission due to loosening of the connection. Moreover, the rear side of the mating base (15) disposes a plurality of connection terminals (16) which are exposed in the notch (153). When the mating connector (1) connects with the female connector assembly (2), the notch (153) engages with the block (212) in the slot (211). A cone-shape stopping area (154) in the front of the mating base (15) helps with the positioning of the mating connector (1), whereby the connection terminals (16) connect to the connection terminals (232), as shown in FIG. 6. However, the input and output of data in each connection terminal (16) is completed via the transmission cable (14).

Figure 5:
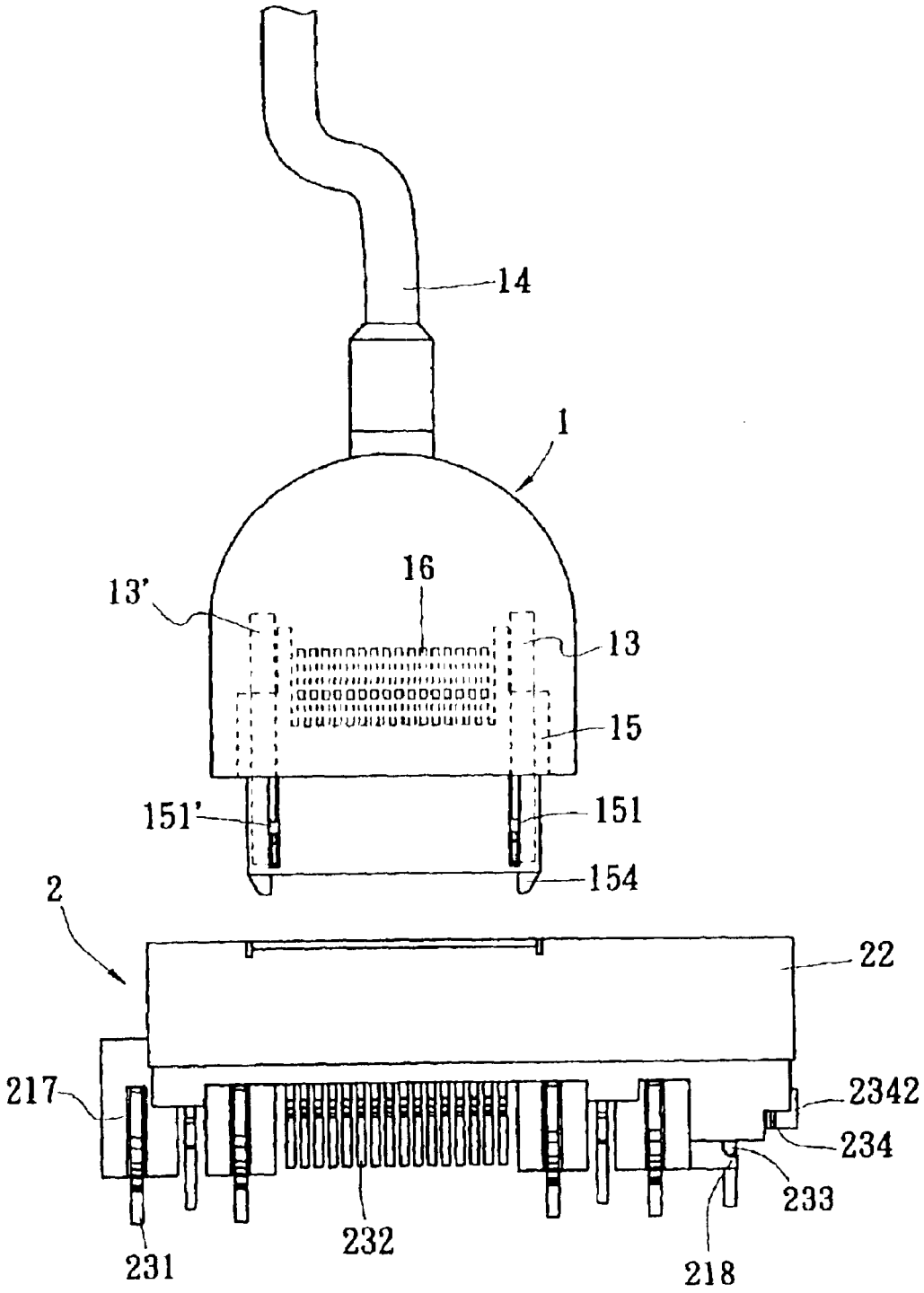
FIG. 5 is a top view of the connection between the female connector assembly and mating connector of the present invention.

As mentioned above, referring to FIGS. 5 and 6, when mating the mating connector (1) and the female connector assembly (2), the notch (153) of the mating base (15) is pushed into the slot (211) and interlocked with the block (212) thereof. Moreover, when the cone-shape stopping area (154) in the front of the mating base (15) is pushed forward, the groove-mount members (13, 13') correspondingly contact and mount on the stopping wall (221) of the metal shield (22) thereby forming a stopping mechanism. The connection terminals (16) then make connection with the connection terminals (232) proceeding data transmission. Upon releasing, one only needs to press the pressing area (111) on the upper cover (11) thereby releasing the groove-mount members (13, 13') from the stopping wall (221), and then separates the female connector assembly (2) from the mating connector (1). Unlike the conventional electrical connector, the connection structure of the present invention does not depend on the connection terminals. Therefore the lifetime of the connection terminals (16, 232) are extended, and data transmission is completed accurately.

Figure 7:
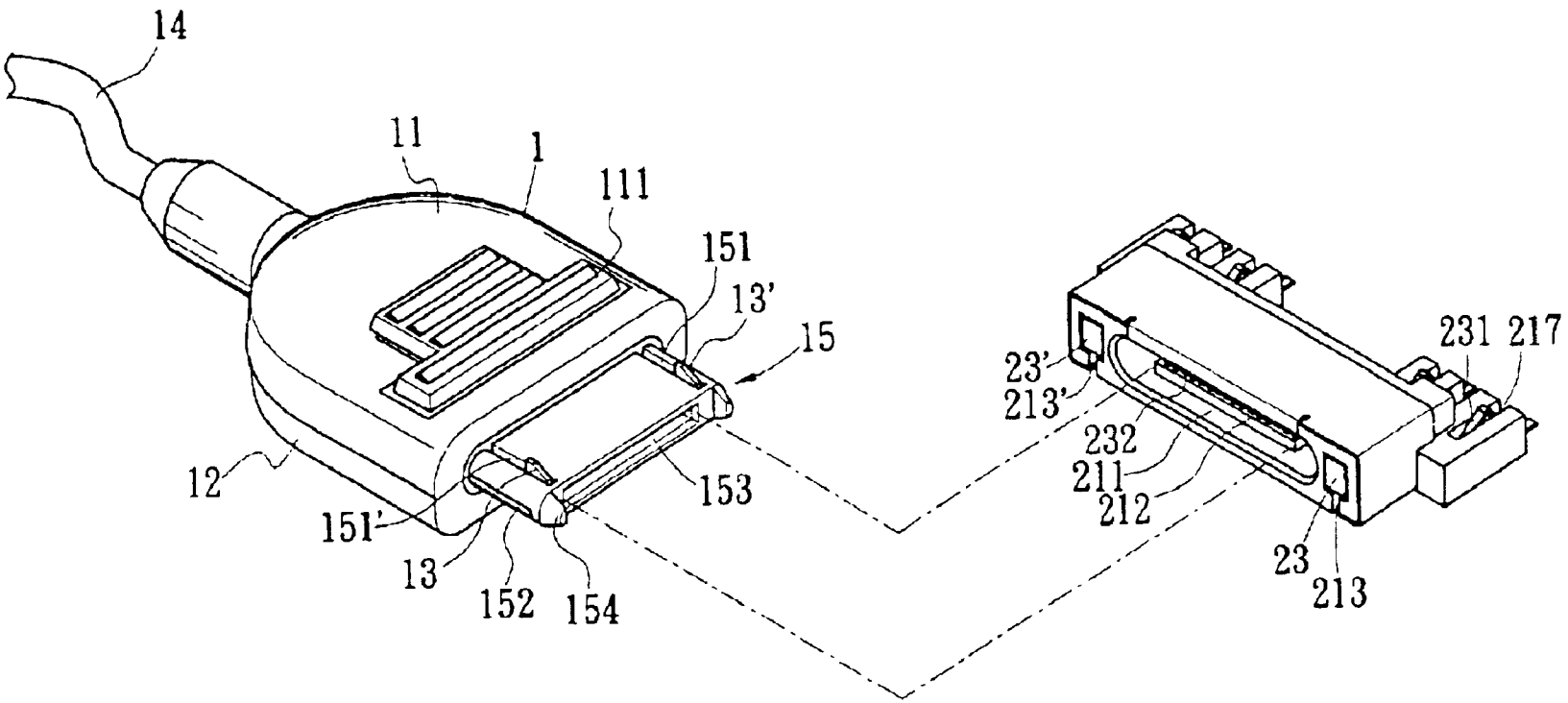
FIG. 7 is a perspective exploded drawing of the present invention showing another preferred embodiment being assembled.

Moreover, referring to FIG. 7, a perspective drawing of the present invention showing another preferred embodiment being assembled, a female connector assembly (2') herein has similar structure to the female connector assembly (2) mentioned above (please also refer to FIG. 1). Compared to the female connector assembly (2), the round port (214) structure including components such as power supply (233) and stopping terminal (234) is absent in the preferred embodiment of the female connector assembly (2') herein. The power storage of this preferred embodiment can only be transmitted through the U-shape pins (23, 23') on both sides of the slot (211). It does not provide connection for a round plug (3) of the conventional power adaptor, although the way of mating between the mating connector (1) and the female connector assembly (2') remains the same. The purpose hereof is to provide an alternative design for the preferred embodiment.

To sum up, the present invention has been described with preferred embodiments thereof and it is understood that many changes and modifications in the described embodiments can be carried out without departing from the scope and the spirit of the invention that is intended to be limited only by the appended claims.

What is claimed is:

1. An electrical connector assembly comprising:

a female connector connected with the mating connector and having:

a) a container base having a plurality of slot ways, a hole, two open slots, and a slot located between the two open slots;

b) a metal shield body located on an exterior of the container base and having a stopping wall located on a top of an interior of the slot;

c) a block located in the slot;

d) a power supply located in the hole;

e) a plurality of first container base connectors, each of the plurality of first container base connectors is located in one of the plurality of slot ways;

f) a plurality of second container base connectors connected to the block; and g) two U-shaped pins connected to the power supply and transmitting power, each of the two U-shaped pins is inserted into one of the two open slots.

2. The according to claim 1, further comprising a round port located on one side of the container base.

3. The according to claim 1, wherein a first of the two U-shaped pins is a positive pole and a second of the two U-shaped pins is a negative pole.

* * * * *